US005285662A

United States Patent [19]

Lonati et al.

[11] Patent Number: 5,285,662

[45] Date of Patent: Feb. 15, 1994

[54] SINGLE-CYLINDER CIRCULAR KNITTING MACHINE FOR MANUFACTURING SOCKS AND STOCKINGS OR THE LIKE

[75] Inventors: Francesco Lonati; Tiberio Lonati; Ettore Lonati; Fausto Lonati, all of Brescia, Italy

[73] Assignee: S.F.I.M. S.r.l., Brescia, Italy

[21] Appl. No.: 984,622

[22] Filed: Dec. 2, 1992

[30] Foreign Application Priority Data

Dec. 17, 1991 [IT] Italy ..... MI91A003369

[51] Int. Cl.[5] ..... D04B 9/46

[52] U.S. Cl. ..... 66/95; 66/8; 66/21

[58] Field of Search ..... 66/8, 21, 15, 31, 95

[56] References Cited

U.S. PATENT DOCUMENTS

| | | | |
|---|---|---|---|
| 2,873,594 | 2/1959 | Larkin | 66/95 |
| 3,340,707 | 9/1967 | Currier | 66/95 |
| 3,470,715 | 10/1969 | Parthum | 66/95 |
| 3,479,841 | 11/1969 | Kitahara et al. | 66/8 |
| 3,609,998 | 10/1971 | Mutze et al. | 66/95 |
| 3,791,175 | 2/1974 | Imboden | 66/21 X |
| 3,841,113 | 10/1974 | Lucke et al. | 66/95 |
| 3,974,663 | 8/1976 | Vinci et al. | 66/95 X |
| 4,718,256 | 1/1988 | Lonati | 66/95 |

FOREIGN PATENT DOCUMENTS

| | | |
|---|---|---|
| 2614722 | 10/1976 | Fed. Rep. of Germany . |
| 2814324 | 10/1978 | Fed. Rep. of Germany . |

*Primary Examiner*—Clifford D. Crowder
*Assistant Examiner*—John J. Calvert
*Attorney, Agent, or Firm*—Guido Modiano; Albert Josif; Daniel O'Byrne

[57] ABSTRACT

The single-cylinder circular knitting machine has a vertically arranged needle cylinder with a skirt defining a plurality of axial grooves. Each groove slidingly accommodates a needle. A platen is arranged coaxially above the needle cylinder, and a plurality of radial grooves is defined therein. Each one of the radial grooves accommodates a hook which is movable by the action of actuation cams which can be engaged, during rotation of the platen about its axis, with a heel of the hooks, from a position in which the hooks are retracted in the platen to an extraction position, and vice versa. The machine is provided with a hook locking device which is arranged proximate to the platen and is controllably engageable with the hooks to keep them in the retracted position in the platen.

13 Claims, 2 Drawing Sheets

SINGLE-CYLINDER CIRCULAR KNITTING MACHINE FOR MANUFACTURING SOCKS AND STOCKINGS OR THE LIKE

BACKGROUND OF THE INVENTION

The present invention relates to a single-cylinder circular knitting machine for manufacturing socks and stockings and in particular to a machine with high safety against the accidental escape of the hooks from the platen.

As is known, single-cylinder circular knitting machines generally comprise a needle cylinder which is arranged vertically and on whose skirt a plurality of axial grooves is defined; each one of said grooves slidingly accommodates a needle.

Needle actuation cams are arranged around the needle cylinder and define paths within which a heel of the needles, which protrudes radially from the related groove, engages. The shape of said paths is such as to give, during the rotation of the needle cylinder about its axis with respect to the needle actuation cams, a reciprocating movement to the needles along the related groove. By means of this reciprocating movement, the needles form knitting by cyclically picking up a thread provided at a feed of the machine and forming new loops linked to the previously formed loops of knitting.

Above the needle cylinder there is usually a platen which is arranged coaxially to the needle cylinder and has a plurality of radial grooves, each accommodating a hook.

Each hook is provided with one or more heels which protrude upward from the radial grooves and engage paths defined by cams for the actuation of the hooks which face the platen in an upward position. The actuation of the platen with a rotary motion about its axis, together with the needle cylinder, causes the various hooks to follow these paths, which are shaped so as to move the hooks from a retracted position in the platen to an extraction position in which the hooks protrude radially with their tip from the platen.

The radial grooves of the platen are offset with respect to the axial grooves of the needle cylinder so that each hook can protrude from the platen between two contiguous needles.

The use of the hooks during the operation of these machines is limited to a particular process. In the production of stockings, the use of the hooks is usually limited to the initial step of the process, i.e. during the forming of the upper edge of the stocking, when the hooks are extracted from the platen to form a tubular border in cooperation with the needles. During the forming of the remaining part of the stocking, the hooks generally remain unused and are kept in the platen in a retracted position.

In order to avoid complicating the profile of the hook actuation cams excessively, said cams are limited to a cam which causes the extraction of the hooks and to a cam which causes their retraction, said cams being mutually angularly spaced with respect to the axis of the platen.

For this reason, when the extraction of the hooks is not required, said hooks could protrude accidentally from the platen due to the centrifugal force generated by the rotation of the platen together with the needle cylinder. In order to avoid this unwanted movement, which would cause unwanted alterations in the process in progress, the stem of the hooks is appropriately bent laterally in one or more points of its extension so that by resting against the lateral walls of the related radial groove, it withstands by friction the centrifugal force to which it is subjected.

This solution, which has long been adopted in the field of single-cylinder circular knitting machine for manufacturing socks and stockings, has some problems particularly in modern machines, which can reach high speed rotation.

In fact, in order to overcome the high centrifugal forces which act on the hooks it is necessary to obtain an increasingly higher friction between the hooks and the radial grooves of the platen. This friction force, whose effect is desirable when the hooks must not be used, becomes disadvantageous when the hooks must be actuated in one direction or the other along the radial grooves. In this occasion the friction force in fact opposes the action of the cams, and the higher the friction force, the higher the force exchanged between the heels of the hooks and the hook actuation cams. Since the wear of the heels is directly correlated to said force, there is a rapid wear of the heels of the hooks, particularly in machines operating at high speed, which necessitates frequent maintenance interventions in order to replace the hooks.

Furthermore, the friction force which acts on the hooks generates a negative torque on the platen which compels one to oversize the rotational connection between the needle cylinder and the platen in order to avoid accidental displacements between the platen and the needle cylinder, which are particularly dangerous during the extraction of the hooks, since they would cause the breakage or damage of the needles and hooks.

The friction force, which is intentionally increased by bending the hooks or with equivalent contrivances, has so far necessitated the adoption of high-strength mechanical connections between the needle cylinder and the platen and has discouraged the adoption of other types of connection.

SUMMARY OF THE INVENTION

The aim of the present invention is to solve the above described problems by providing a single-cylinder circular knitting machine, particularly for manufacturing socks and stockings wherein it is possible to safely avoid the accidental escape of the hooks of the platen despite an extremely modest friction between the hooks and the radial grooves of the platen.

Within the scope of this aim, an object of the invention is to provide a machine which can reach high operating speeds without incurring problems regarding the retention of the hooks in the grooves of the platen.

Another object of the invention is to provide a machine wherein the wear of the heels of the hooks is reduced.

A further object of the invention is to provide a machine with a platen which can be rotated about its own axis with a reduced torque with respect to that required by conventional machines.

Yet another object of the invention is to provide a machine wherein the rotational linkage between the needle cylinder and the platen can be provided in an extremely simple and reliable manner.

This aim, these objects and others which will become apparent hereinafter are achieved by a single-cylinder circular knitting machine particularly for manufacturing socks and stockings, comprising a vertically arranged needle cylinder having a skirt, a plurality of axial grooves defined in said skirt, each groove slideably accommodating a needle, a platen arranged coaxially above said needle cylinder, a plurality of radial grooves defined in said platen, each one of said radial grooves slideably accommodating a hook, cams being provided for the actuation of said hooks, said cams facing said platen in an upward position and defining paths engageable by at least one heel of said hooks which protrudes upward from said radial grooves in order to move said hooks, upon the rotation of said platen about its own axis with respect to said actuation cams, from a position in which said hooks are retracted in the platen to an extraction position, and vice versa, characterized in that it comprises a hook locking device arranged proximate to said platen and being controllably movable from an inactive position, whereat said device does not interfere with said hooks, to an active position, whereat said device engages said hooks in said retracted position to retain them in said retracted position, and vice versa.

BRIEF DESCRIPTION OF THE DRAWINGS

Further characteristics and advantages of the invention will become apparent from the description of a preferred but not exclusive embodiment of a machine according to the invention, illustrated only by way of non-limitative example in the accompanying drawings, wherein.

DESCRIPTION OF THE PREFERRED EMBODIMENTS

Figure 1:
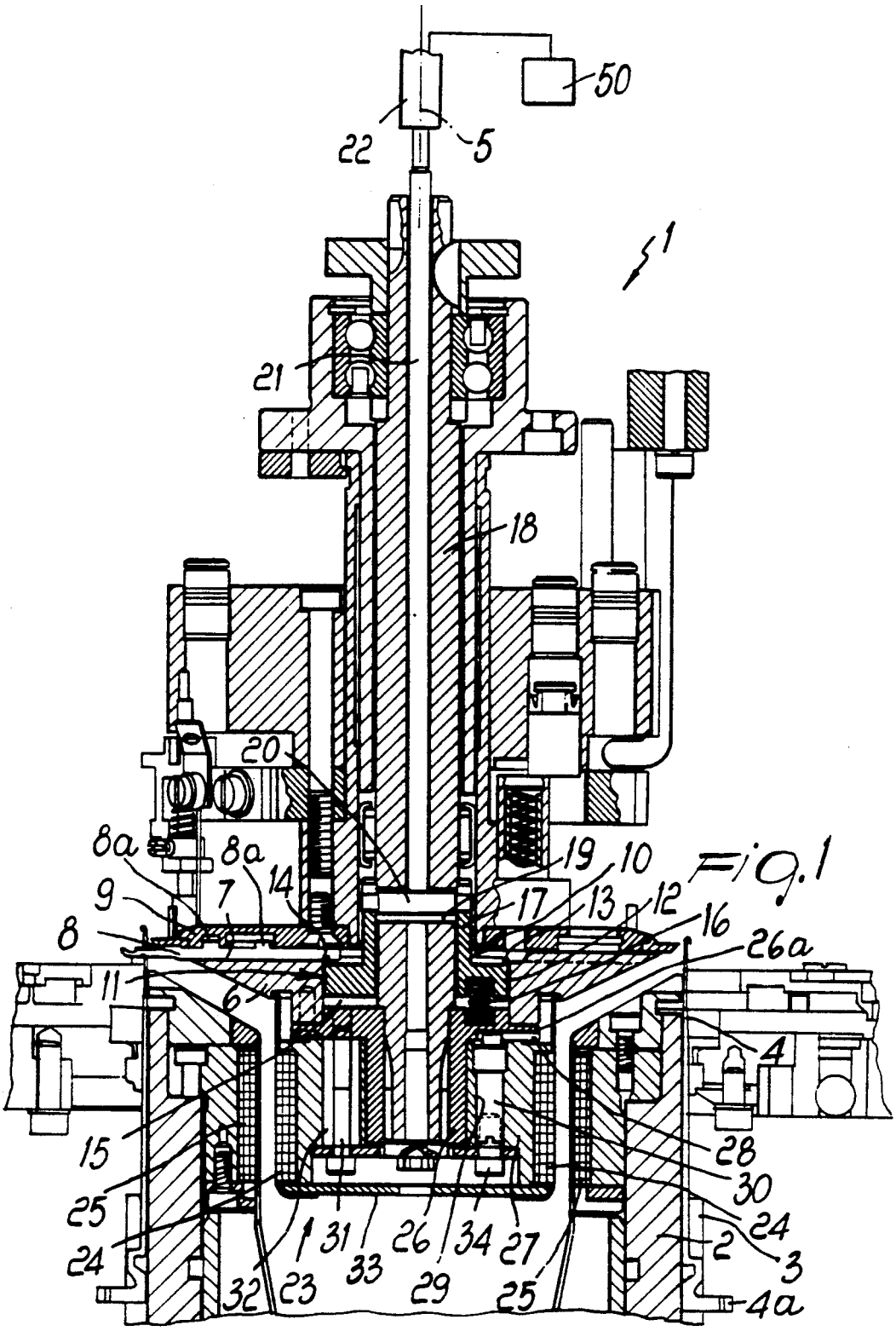
FIG. 1 is a schematic axial sectional view of a single-cylinder circular knitting machine for manufacturing socks and stockings, with the hook locking device in active position.

With reference to the above figures, the machine according to the invention, generally designated by the reference numeral 1, comprises a needle cylinder 2 arranged vertically and comprising a skirt, having a plurality of axial grooves 3 defined therein; each one of said grooves slideably accommodates a needle 4 which has a heel 4*a* protruding radially from the grooves 3.

A plurality of needle actuation cams, of a per se known type which is not illustrated for the sake of simplicity, is arranged around the needle cylinder 2; said cams define paths in which the heels 4*a* of the needles engage.

Said paths have ascending and descending portions, and the needle cylinder 2 can be actuated in a known manner with a rotary motion about its own axis 5 with respect to the needle actuation cams so that the sliding of the heels 4*a* along the paths defined by said cams actuates the needles in a direction which is parallel to the axis 5 and makes them cyclically protrude upward from the needle cylinder, in order to engage a thread which is fed to them at the feeds or drops of the machine, and retract into the needle cylinder, forming new loops of knitting linked to the previously formed loops which are unloaded from the needles and descend toward the inside of the needle cylinder.

A platen 6 is arranged above the needle cylinder 2, and its axis coincides with the axis 5 of the needle cylinder 2.

A plurality of radial grooves 7 is defined on the upper face of the platen 6; each one of said grooves slidingly accommodates a hook 8 provided with one or more heels 8*a* which protrude upward from the platen 6 and engage hook actuation cams 9 facing the platen 6 in an upward position. Said cams 9 have portions which move toward the axis 5 and portions which move away from said axis, so that by actuating the plate 6 with a rotary motion together with the needle cylinder 2, the hooks 8 pass, when required, from a retracted position in the platen 6 to an extraction position in which they protrude radially with their tip from the platen 6, and vice versa.

The radial grooves 7 of the platen 6 are angularly offset about the axis 5 with respect to the axial grooves 3 of the needle cylinder 2, so that each hook 8 can protrude from the platen between two contiguous needles 4 without interfering with them.

According to the invention, the machine comprises a hook locking device, generally designated by the reference numeral 10, which is arranged proximate to the platen 6 and can move controllably from an inactive position, in which it does not interfere with the hooks 8, to an active position, in which it engages the hooks 8 in a retracted position so as to retain them in said retracted position despite the action of centrifugal force which acts on them during rotation of the platen 6 about the axis 5.

More particularly, the locking device 10 comprises a locking element 11 which is slidably accommodated in the platen 6 along the axis 5. Said locking element 11 has a disk-like portion 12, whose axis coincides with the axis 5, arranged inside the platen 6 below the hooks 8. The disk-like portion 12 has a perimetric edge 13 which is raised and engageable with a recess 14 appropriately provided on the back of the hooks 8 proximate to their end directed toward the axis 5. The recess 14 is located at the perimetric edge 13 when the related hook is in the retracted position in the platen 6.

The locking element 11 is accommodated in a seat 15 defined in the platen 6, and springs 16 are interposed between the lower face of the locking element 11 and the bottom of said seat 15; said springs act on the locking element to keep its perimetric edge 13 engaged with the hooks 8.

The locking element 11 is centrally provided with a sleeve 17 axially slideably mounted on a shaft 18 which passes coaxially through the platen 6.

The shaft 18 is rigidly coupled to the platen 6 in rotation about the axis 5, and proximate to the sleeve 17 it is traversed by a hole 19 which is perpendicular to the axis 5 and has a transverse cross-section which is elongated parallel to the axis 5. The sleeve 17 is transversely crossed by a secondary shaft 20 which also passes through the hole 19 so as to rigidly couple the locking element 11 to the shaft 18 in rotation about the axis 5 but allow it to slide axially with respect to the shaft 18 by an axial extent which is delimited by the width of the hole 19 in the direction which is parallel to the axis 5.

As an alternative, the hole 19 can have a circular cross-section with a diameter which is greater than that of the secondary shaft by an amount which is greater than the height of the perimetric edge 13.

Actuation means act on the locking element 11 in order to move it from the active position to the inactive position against the biasing action of the springs 16.

The shaft 18 is hollow and the actuation means comprise a rod 21 which is slideably accommodated inside the shaft 18 for sliding movement along the axis 5. The lower end of the rod 21 rests on the secondary shaft 20, whereas its upper end protrudes from the shaft 18. Actuation means 22, for example of the pneumatic, electromagnetic or mechanical type, or equivalent means are arranged proximate to the upper end of the rod 21 and controllably act on said rod 21 so as to cause its translatory motion along the shaft 18 and move the locking element 11 from the active position to the inactive one.

The actuation means 22 are operatively connected to an electronic control element 50 which supervises the operation of the machine and actuates the locking device 10 according to the requirements of production.

Preferably, the platen 6 is connected to the needle cylinder 2 in rotation about the axis 5 by means of a magnetic coupling.

More particularly, the shaft 18 extends below the platen, and its lower end is associated with a cylindrical support 23 arranged inside the needle cylinder 2, proximate to the upper end thereof.

The skirt of the cylindrical support 23 faces the inner surface of the needle cylinder 2 and first magnetically active inserts 24, fixed to said cylindrical supports 23, are distributed about the axis 5. The inserts 24 face secondary magnetically active inserts 25 which are applied to the inner surface of the needle cylinder and are arranged correspondingly. In this manner, if the needle cylinder 2 is actuated with rotary motion about the axis 5, the platen 6 also rotates.

The displacement between the needle cylinder and the platen, during acceleration or deceleration imparted to the needle cylinder, is negligible and is not in any case such as to produce interference between needles 4 and hooks 8, since the negative torque which opposes the rotation of the platen 6 is extremely modest as a consequence of the adoption of the device 10 for locking the hooks 8, which allows to reduce the friction between the hooks 8 and the radial grooves 7 to minimal levels.

Conveniently, the cylindrical support 23 is produced in two mutually coaxial parts, respectively 26 and 27, to allow the correct mutual timing of the needle cylinder 2 and the platen 6 during assembly of the machine.

More particularly, the part 26 is arranged inside the part 27 and is rigidly fixed to the shaft 18.

The part 26 is provided with an upper disk-like end **26*a* with at least one radial groove 28 against which the upper end of the part 27** rests.

At least one axial hole 29 is defined in the part 27 and rotatably accommodates an eccentric pivot 30 which engages the groove 28 with one of its ends. By rotating the eccentric pivot 29 about its axis, with the part 27 not fixed to the part 26, the angular position of the part 27 is changed with respect to the part 26. The locking of the part 27 on the part 26 is provided by means of screws 31 which cross, with such a play as to allow a partial rotation of the part 27 with respect to the part 26 as required during timing, axial holes 32 which are defined in the part 27.

The screws 31 engage threaded holes defined in the upper disk-like end **26*a*, and a cover 33 is interposed between the head of the screws 30 and the part 27. In addition to the holes for the passage of the screws 31, holes at each eccentric pivot are defined in the cover 33, for the passage of a fixing screw 34 which is screwed in the eccentric pivot 30** after performing timing in order to lock it.

The operation of the machine according to the invention is as follows.

During the execution of processes which do not require the use of the hooks 8, the locking device 10 is kept in an active position by the action of the springs 16. In this position, the locking element 11 keeps the hooks 8 in a retracted position in the platen 6 with absolute safety, even with high rotation speeds of the platen 6 (FIG. 1).

It should be noted that the locking element 11 rotates together with the platen 6 about the axis 5, and thus no wear occurs between the locking element 11 and the hooks 8.

Figure 2:
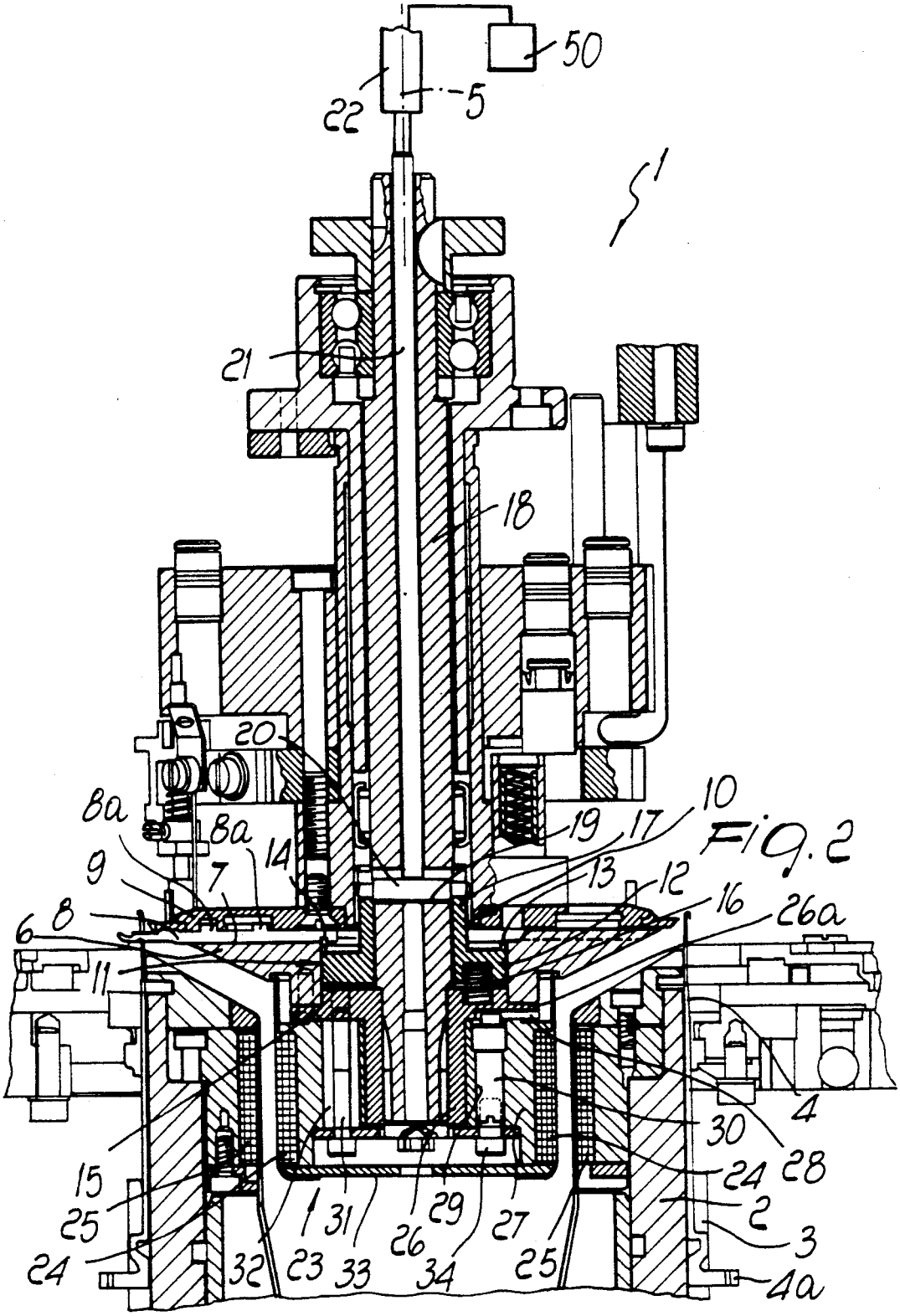
FIG. 2 is an axial sectional view of the machine, taken similarly to FIG. 1, with the hook locking device in inactive position.

When the use of the hooks 8 is required, the electronic control element 50 of the machine activates the actuator 22 which, by pressing on the rod 21, disengages the locking element 11 from the hooks 8, overcoming the action of the springs 16 (FIG. 2). In this manner, the hooks 8 can be actuated as in conventional machines to take part in the knitting in progress.

When the hooks 8 must be again disengaged from work, the actuator 22 is deactivated so that the springs 16 return the locking element 11 to the active position (FIG. 1).

In practice it has been observed that the machine according to the invention fully achieves the intended aim, since by virtue of the hook locking device it achieves a highly reliable retention of the hooks inside the platen even with high-speed rotation of the platen and with extremely modest friction between the hooks and the platen.

A further advantage of the machine according to the invention is that it is possible to use a connection which adopts a magnetic coupling, which is considerably simpler than conventional couplings between the platen and the needle cylinder, again as a consequence of the fact that the friction between the hooks and the platen can be extremely modest and that the negative torque which contrasts the rotation of the platen is therefore also modest.

The machine thus conceived is susceptible to numerous modifications and variations, all of which are within the scope of the inventive concept; furthermore, all the details may be replaced with technically equivalent elements.

In practice, the materials employed, so long as they are compatible with the specific use, as well as the dimensions, may be any according to the requirements and the state of the art.

We claim:

1. Single-cylinder circular knitting machine particularly for manufacturing socks and stockings, comprising, a vertically arranged needle cylinder having a skirt and an axis, a plurality of axial grooves defined in said skirt, a needle slideably accommodated in each of said grooves, a platen arranged coaxially above said needle cylinder, a plurality of radial grooves defined in said platen, hooks slideably accommodated in said radial grooves, at least one heel provided on each of said hooks and protruding from said radial grooves, actuation cams facing said platen and defining paths, said paths being engageable by said at least one heel of each of said hooks for moving said hooks upon rotation of said platen about said axis with respect to said actuation cams, between a retraction position whereat said hooks are retracted in said radial grooves of said platen and an extraction position whereat said hooks are extracted from said radial grooves of said platen, said machine further comprising a hook locking device, said hook locking device being arranged proximate to said platen and controllably movable between an inactive position, whereat said hook locking device does not interfere with said hooks, and an active position, whereat said hook locking device engages said hooks in said retracted position for retaining said hooks in said retracted position.

2. Machine according to claim 1, wherein said hook locking device comprises a locking element, said locking element being accommodated in said platen and controllably slideable parallel to said axis for passing between said active position and said inactive position.

3. Machine according to claim 2, wherein said hook locking element is rigidly coupled to said platen in rotation about said axis.

4. Machine according to claim 2, wherein said hook locking element has a disk-like portion, said disk-like portion being arranged coaxially to said platen and below said hooks and having a raised perimetric edge, and wherein said hooks each have an end directed towards said axis, and a back defining a recess, said recess being defined proximate to said end, said raised perimetric edge being engageable with said recess.

5. Machine according to claim 1, wherein said locking device comprises a locking element, said locking element being centrally provided with a sleeve, said sleeve being slideable along a shaft, said shaft being arranged coaxially to said platen and rigidly coupled thereto in rotation about said axis.

6. Machine according to claim 5, further comprising means for delimiting axial sliding movement of said locking element along said shaft.

7. Machine according to claim 6, wherein said means for delimiting axial sliding movement of said locking element along said shaft comprise a secondary shaft, said secondary shaft transversely crossing said sleeve and being slideably accommodated in a hole, said hole crossing said shaft transversely and having a transverse cross-section, said transverse cross-section being elongated in a direction parallel to said axis.

8. Machine according to claim 1, further comprising actuation means, said actuation means acting on said locking element for moving said locking element between said active position and said inactive position.

9. Machine according to claim 7, wherein said shaft is hollow and has an upper end, and wherein said actuation means comprise a rod having a lower end, said rod being slideably accommodated in said shaft and extending from said hole accommodating said secondary shaft and protruding from said upper end of said shaft, said rod being axially movable along said shaft for acting with said lower end on said secondary shaft, whereby to move said locking element between said active position and said inactive position against elastic means.

10. Machine according to claim 9, wherein said locking element has a lower face, and wherein said platen has defined therein a seat having a bottom and slideably accommodating said locking element, said elastic means being interposed between said lower face of said locking element and said bottom of said seat.

11. Machine according to claim 1, wherein said platen is connected to said needle cylinder in rotation about said axis by magnetic coupling means.

12. Machine according to claim 5, wherein said platen is connected to said needle cylinder in rotation about said axis by magnetic coupling means, said magnetic coupling means comprising first magnetically active inserts and secondary magnetically active inserts, said secondary magnetically active inserts being connected to said skirt of said needle cylinder and being distributed around said axis proximate to an upper end of said needle cylinder, said shaft having an extension and a cylindrical support, said extension protruding downwardly from said platen, said cylindrical support being connected to said extension and arranged inside said needle cylinder facing said secondary magnetically active inserts, said first magnetically active inserts interacting with said secondary magnetically active inserts and being distributed around said axis and fixed on said cylindrical support.

13. Machine according to claim 12, further comprising means for angular position adjustment of said cylindrical support about said axis with respect to said shaft.

* * * * *

UNITED STATES PATENT AND TRADEMARK OFFICE

CERTIFICATE OF CORRECTION

PATENT NO. : 5,285,662

DATED : February 15, 1994

INVENTOR(S) : LONATI Francesco, LONATI Tiberio, LONATI Ettore, LONATI Fausto

It is certified that error appears in the above-indentified patent and that said Letters Patent is hereby corrected as shown below:

On the title page, item [21], "984,622" should read --984,662--.

Signed and Sealed this

Twenty-first Day of June, 1994

Bruce Lehman

*Attest:*

BRUCE LEHMAN

*Attesting Officer*

*Commissioner of Patents and Trademarks*